US008225725B2

(12) United States Patent
Voris

(10) Patent No.: US 8,225,725 B2
(45) Date of Patent: Jul. 24, 2012

(54) BANQUET TABLE

(75) Inventor: Larry Voris, Nashville, IN (US)

(73) Assignee: Cosco Management, Inc., Wilmington, DE (US)

( * ) Notice: Subject to any disclaimer, the term of this patent is extended or adjusted under 35 U.S.C. 154(b) by 227 days.

(21) Appl. No.: 12/709,262

(22) Filed: Feb. 19, 2010

(65) Prior Publication Data

US 2010/0218706 A1 Sep. 2, 2010

Related U.S. Application Data

(60) Provisional application No. 61/156,363, filed on Feb. 27, 2009.

(51) Int. Cl.
*A47B 3/00* (2006.01)

(52) U.S. Cl. ..... 108/132; 108/129; 248/188

(58) Field of Classification Search ..... 108/132, 108/129, 130, 153.1, 159.12, 158, 157.1; 248/188, 188.1, 163.1, 151
See application file for complete search history.

(56) References Cited

U.S. PATENT DOCUMENTS

| | | | | |
|---|---|---|---|---|
| 1,888,117 | A | 11/1932 | Fox | |
| 3,349,728 | A | 10/1967 | Barecki et al. | |
| 3,357,729 | A | 12/1967 | Krueger | |
| 3,410,232 | A | 11/1968 | Krueger | |
| 3,504,877 | A * | 4/1970 | Lyon, Sr. | 248/188 |
| 3,604,372 | A * | 9/1971 | Hewett et al. | 108/129 |
| 3,854,828 | A * | 12/1974 | Jones | 108/129 |
| 4,951,576 | A | 8/1990 | Cobos et al. | |
| 5,076,521 | A * | 12/1991 | Neubauer | 248/188 |
| 5,165,349 | A * | 11/1992 | McAllister | 248/188 |
| 5,232,303 | A * | 8/1993 | Rubner | 248/188 |
| 5,284,100 | A | 2/1994 | Thorn | |
| 5,333,423 | A * | 8/1994 | Propst | 248/188 |
| 5,528,996 | A * | 6/1996 | Edwards et al. | 248/188 |
| 5,623,882 | A * | 4/1997 | Price | 108/129 |
| 6,422,157 | B2 | 7/2002 | Rumph | |
| 6,629,506 | B2 * | 10/2003 | Park | 248/188 |
| 6,651,568 | B1 * | 11/2003 | Buono | 108/132 |
| 6,694,897 | B2 * | 2/2004 | Lou-Hao | 108/132 |
| 6,772,700 | B2 * | 8/2004 | Wong | 108/132 |
| 6,968,789 | B2 | 11/2005 | Baik et al. | |
| 7,293,749 | B2 * | 11/2007 | Banko | 248/188 |
| 7,459,646 | B1 | 12/2008 | Shi | |
| 2004/0244656 | A1 * | 12/2004 | Shenghao et al. | 108/132 |
| 2004/0255829 | A1 * | 12/2004 | Cizmar et al. | 108/132 |
| 2005/0011422 | A1 * | 1/2005 | Wen | 108/129 |
| 2005/0211141 | A1 * | 9/2005 | Stanford | 108/132 |
| 2006/0021552 | A1 * | 2/2006 | Pleiman et al. | 108/132 |
| 2009/0140110 | A1 * | 6/2009 | Saffell et al. | 248/188 |
| 2010/0224107 | A1 * | 9/2010 | Aldred et al. | 108/129 |

FOREIGN PATENT DOCUMENTS

| | | |
|---|---|---|
| CN | 2345061 | 10/1999 |

* cited by examiner

*Primary Examiner* — Jose V Chen
(74) *Attorney, Agent, or Firm* — Barnes & Thornburg LLP

(57) ABSTRACT

A table in accordance with the present disclosure includes a table top and first and second leg units. Each leg unit is mounted for movement relative to the table top from a closed position alongside the table top to an opened position extending away from the table top.

19 Claims, 6 Drawing Sheets

BANQUET TABLE

This application claims priority under 35 U.S.C. §119(e) to U.S. Provisional Application Ser. No. 61/156,363, filed Feb. 27, 2009, which is expressly incorporated by reference herein.

BACKGROUND

The present disclosure relates to a table, and particularly to a tabletop support unit. More particularly, the present disclosure relates to a center-fold banquet table having a tabletop support unit including movable leg units.

SUMMARY

A table in accordance with the present disclosure includes a table top and first and second leg units. Each leg unit is mounted for movement relative to the table top from a closed position alongside the table top to an opened position extending away from the table top.

In illustrative embodiments, the table top is formed to include a cavity having an opening in a bottom surface on the underside of the table top. The table also includes a fastener located substantially in the cavity and configured to couple a stationary portion of the movable first leg unit to the table top.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
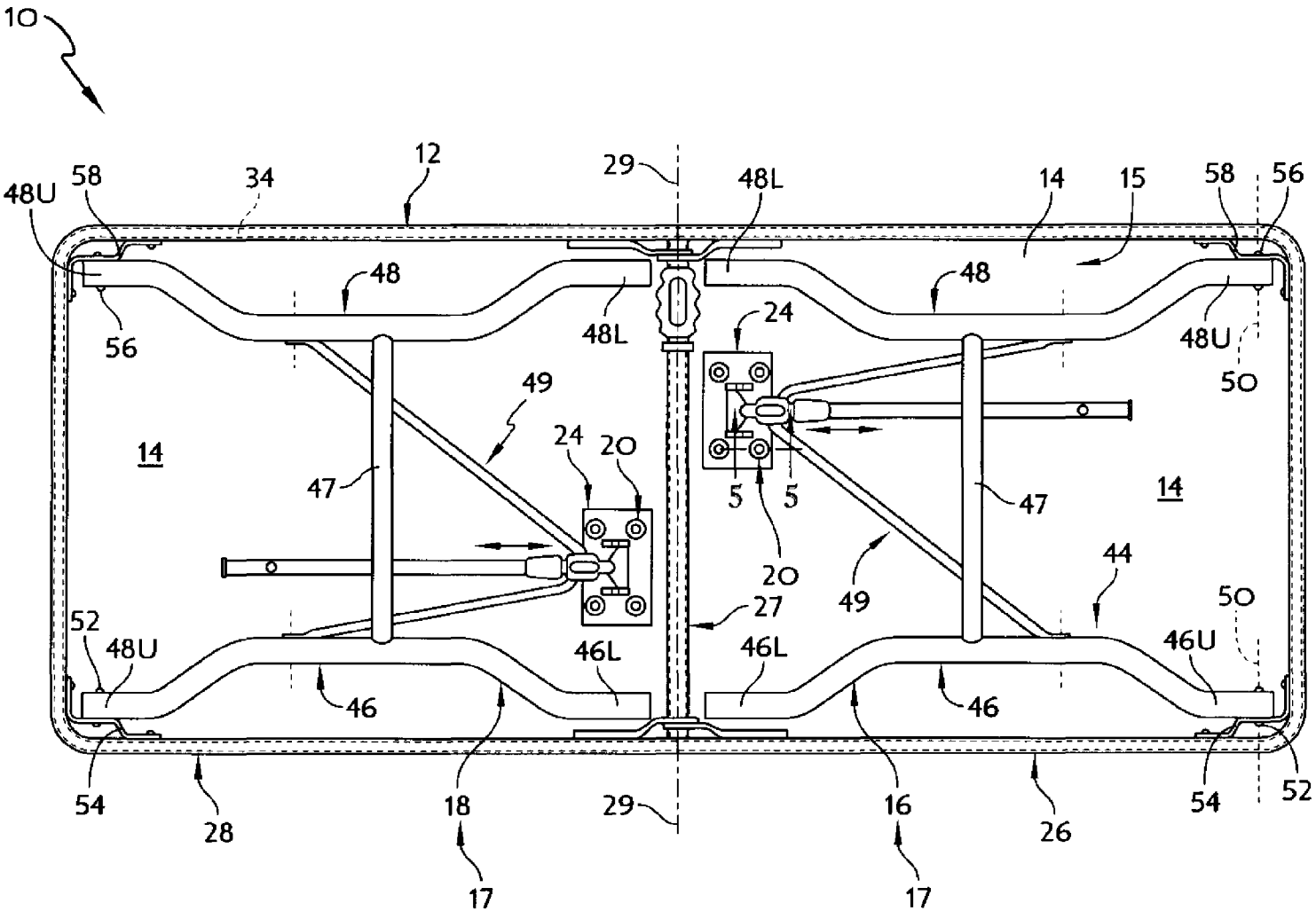
FIG. 1 is a bottom view of a table in accordance with the present disclosure showing the underside of a table top, a first leg unit associated with a right-side portion of the table top and stowed in a collapsed storage position, a second leg unit associated with a left-side portion of the table top and stowed in a collapsed storage position, and a hinge unit configured to support the right-side portion for pivotable movement about an axis relative to the left-side portion from the spread-apart use position shown in FIG. 1 to a folded storage position (not shown)
Figure 3:
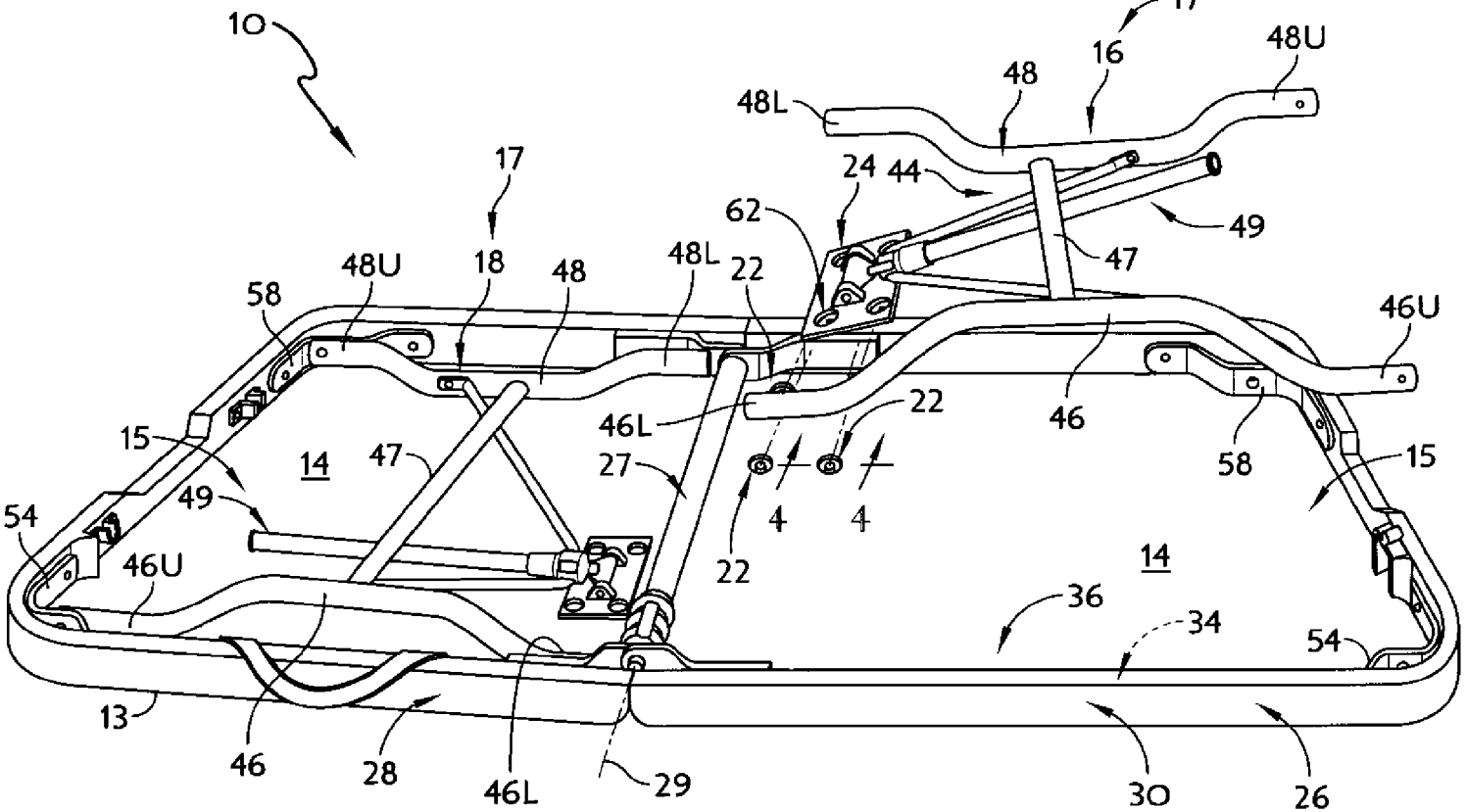
FIG. 3 is a perspective view of the table shown in FIG. 1 showing the first leg unit before it is coupled to the right-side portion of the table top and the second leg unit after it has been coupled to the left-side portion of the table top.
Figure 4:
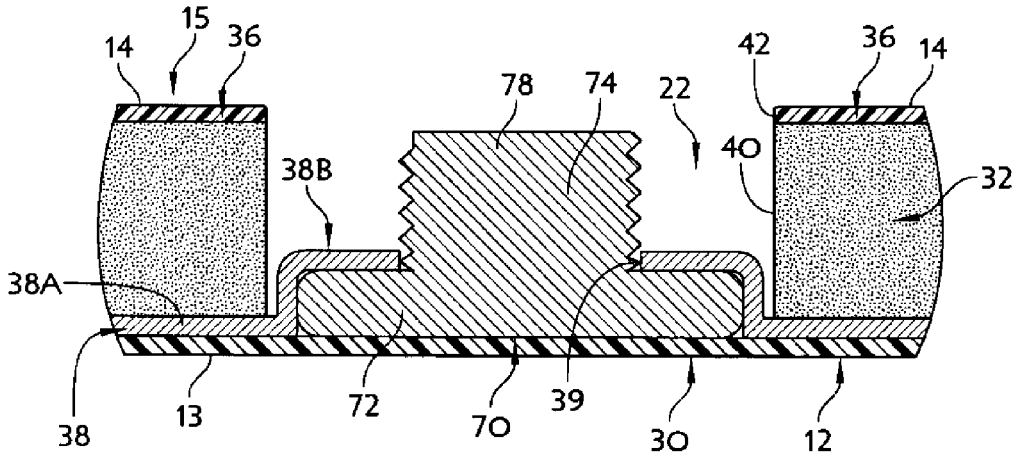
FIG. 4 is an enlarged sectional view taken along line 4-4 of FIG. 3 showing a bolt provided in a cavity formed in the table top and adapted to mate with the leg-unit anchor as suggested in FIG. 5.

Table 10 includes a table top 12 having a top surface 13 and a bottom surface 14 on an underside 15 as shown, for example, in FIGS. 1, 3, and 4. Table 10 also includes a right-side leg unit 16 coupled to tabletop 12 and a left-side leg unit 18 coupled to table top 12 as suggested in FIGS. 1, 3, and 5. As suggested in FIG. 5, table 10 further includes a fastener 20 located in a cavity 22 formed in table top 12 and configured to retain a leg-unit anchor 24 included in the right-side leg unit 16 in a stationary position relative to table top 12.

In the illustrated embodiment, table 10 is a center-fold banquet table including a right-side portion 26, a left-side portion 28, and a hinge unit 27 as suggested in FIGS. 1 and 3. Hinge unit 27 is configured to support right-side portion 26 for pivotable movement about an axis 29 from a spread-apart position shown in FIG. 1 to a folded storage position (not shown) in which right-side and left-side portions 26, 28 are arranged to lie in side-by-side relation to form a compact table that is transported and stored easily. As suggested in FIGS. 1 and 3, first leg unit 16 is coupled to right-side portion 26 of table top 12 and second leg unit 18 is coupled to left-side portion 28 of table top 12.

Figure 5:
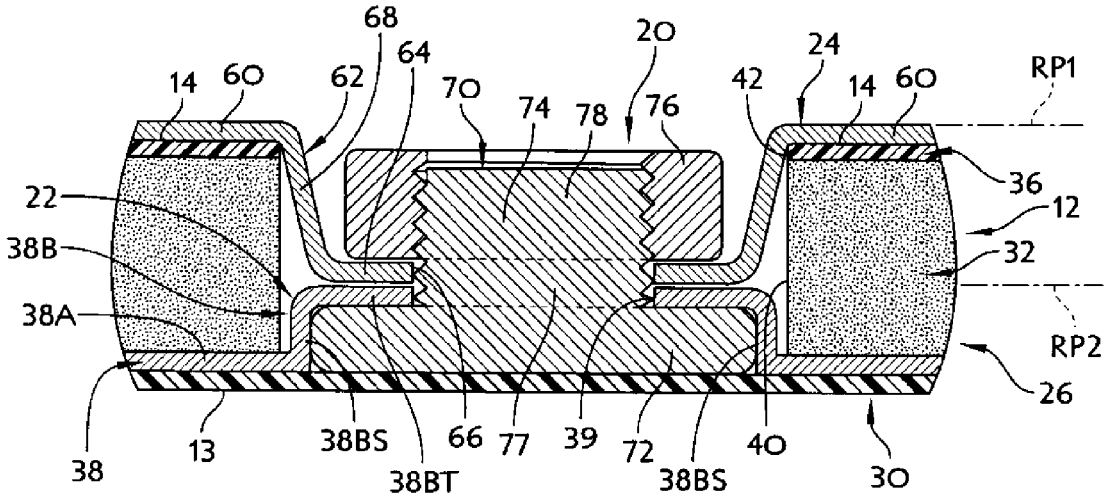
FIG. 5 is an enlarged sectional view taken along line 5-5 of FIG. 1 showing fastener means for coupling the leg-unit anchor to the table top and showing that the fastener means includes the bolt and a nut coupled to the bolt to retain a base plate included in the leg-unit anchor in a stationary position on the table top.
Figure 6:
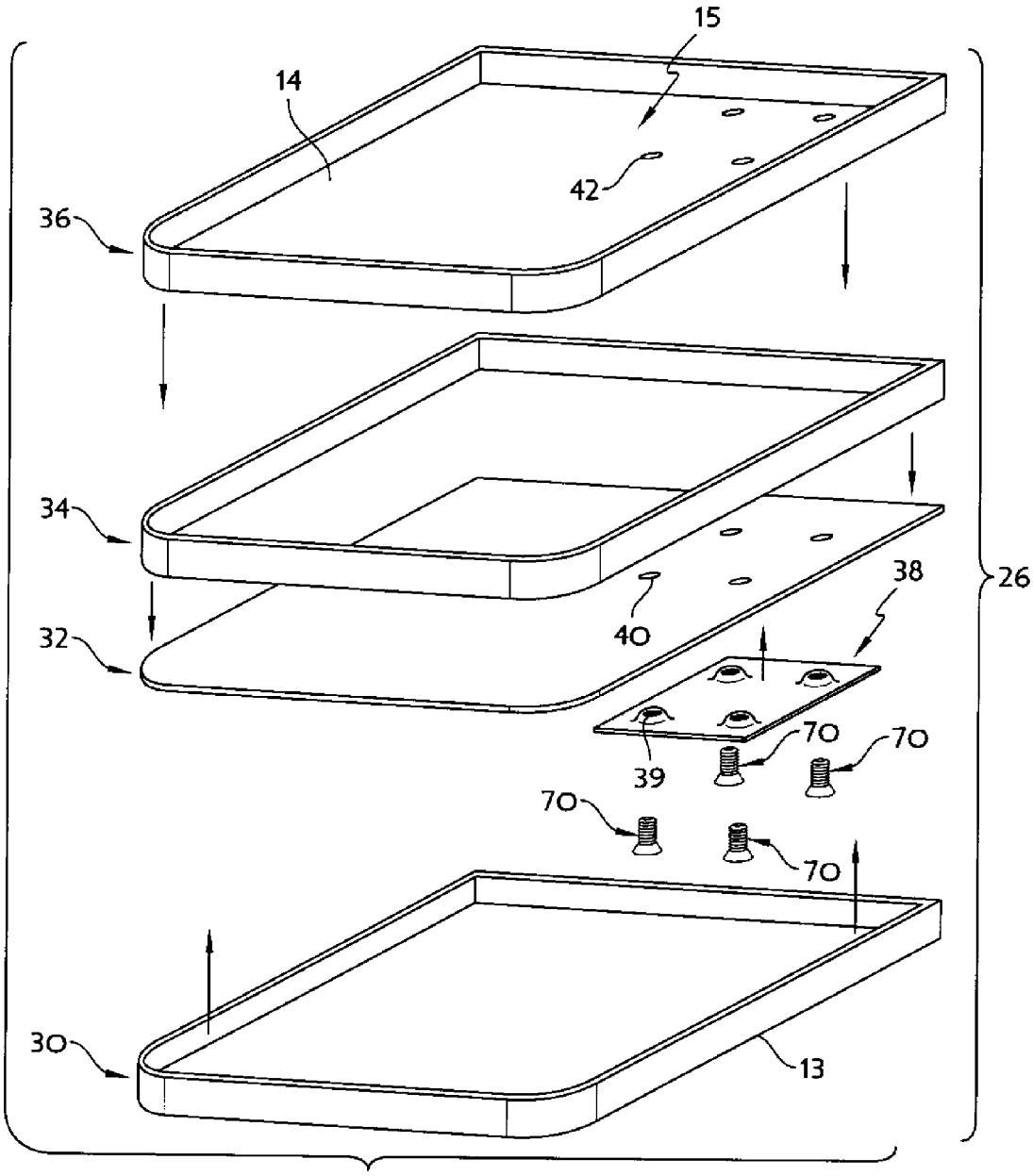
FIG. 6 is an exploded perspective assembly view of the table top shown in FIGS. 1 and 3-5 along with four bolts associated with the leg-unit anchor of the first leg unit.
Figure 6A:
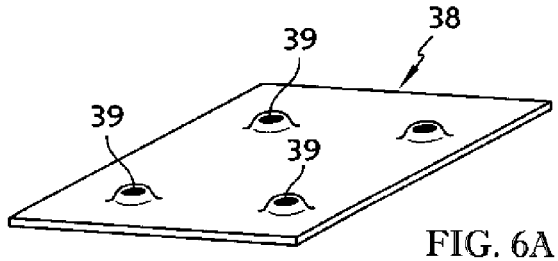
FIG. 6A is an enlarged perspective view of the fastener mooring shown in FIG. 6 and showing four fastener-receiver cavities formed in the fastener mooring.
Figure 7:
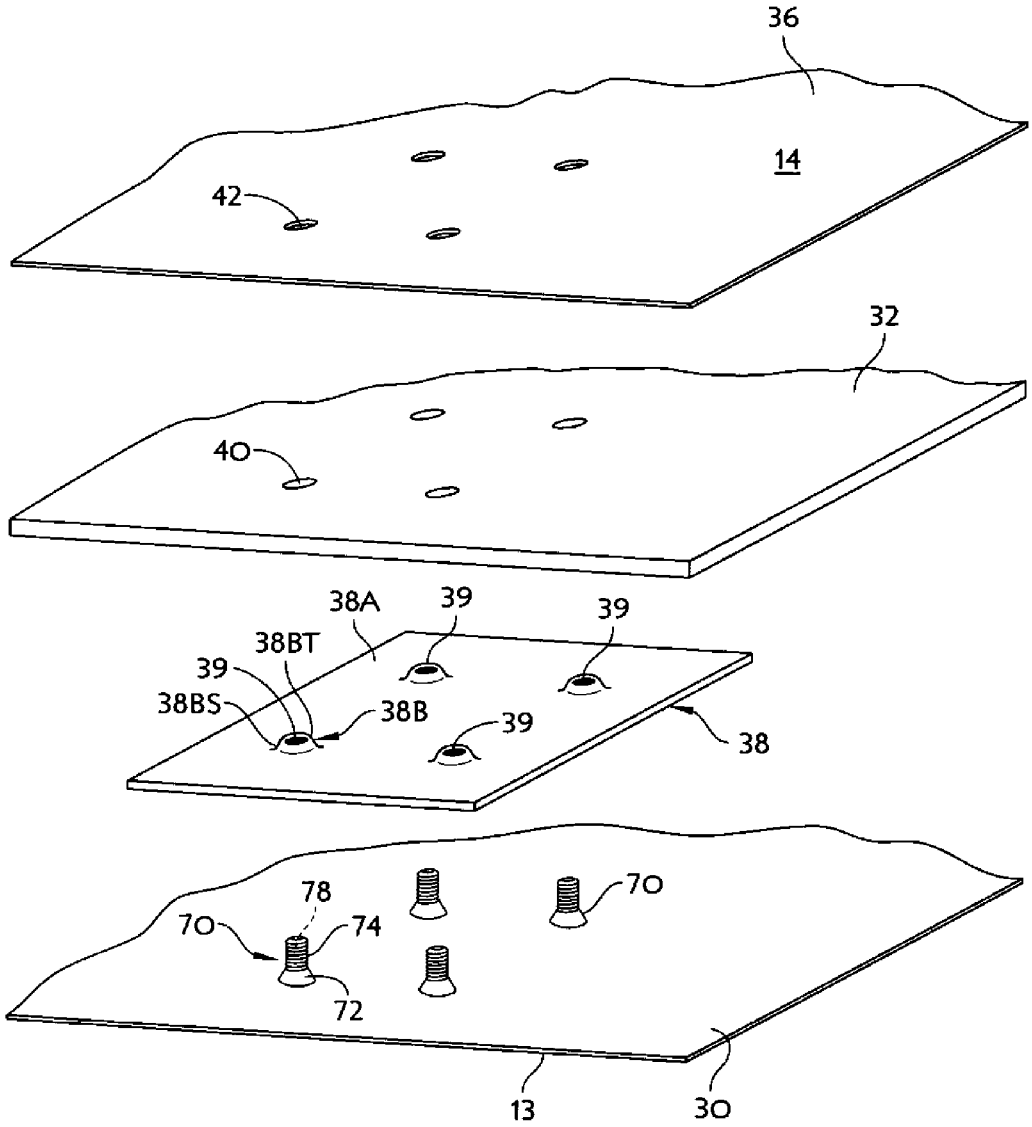
FIG. 7 is an enlarged partial perspective view of several of the elements shown in FIG. 6 prior to assembly of those elements to form the table shown in FIG. 1.

As suggested in FIGS. 6 and 7, in an illustrative embodiment, right-side portion 26 of table top 12 comprises a top 30 formed to include top surface 13, a support board 32 made, for example, of masonite material or honeycomb corrugate, an endless steel frame 34 defining a perimeter edge of right-side portion 26, and a bottom 36 formed to include bottom surface 14. A portion of a fastener mooring 38 is interposed in a space provided between top 30 and support board 32 as suggested, for example, in FIGS. 4-7. Left-side portion 28 has a similar construction in an illustrative embodiment. In illustrative embodiments, each of top 30 and bottom 36 are made using a vacuum-forming process.

As suggested in FIGS. 4, 6, and 7, a hole 40 formed in support board 32 is aligned with and cooperates with a hole 42 formed in bottom 36 to define cavity 22 in table top 12. Fastener 20 is located in cavity 22 and held in place in cavity 22 relative to top 30, support board 32, and bottom 36 at least in part by fastener mooring 38 as suggested in FIG. 5.

Fastener mooring 38 is trapped in a stationary position between top 30 and support board 32 when right-side portion 26 is assembled as suggested in FIG. 5. Fastener mooring 38 is formed to include a fastener-receiver aperture 39 located in cavity 22 and arranged to receive a portion of fastener 20 therein as suggested, for example, in FIG. 5. In an illustrative embodiment, fastener mooring 38 includes a root plate 38A and a retainer 38B arranged to extend into cavity 22 and configured to include a top wall 38BT formed to include fastener-receiver aperture 39 and an annular side wall 38BS arranged to extend from root plate 38A to top wall 38BT. In an illustrative embodiment, four fastener-receiver apertures 39 are formed in fastener mooring 38 as shown best in FIG. 7.

Figure 2:
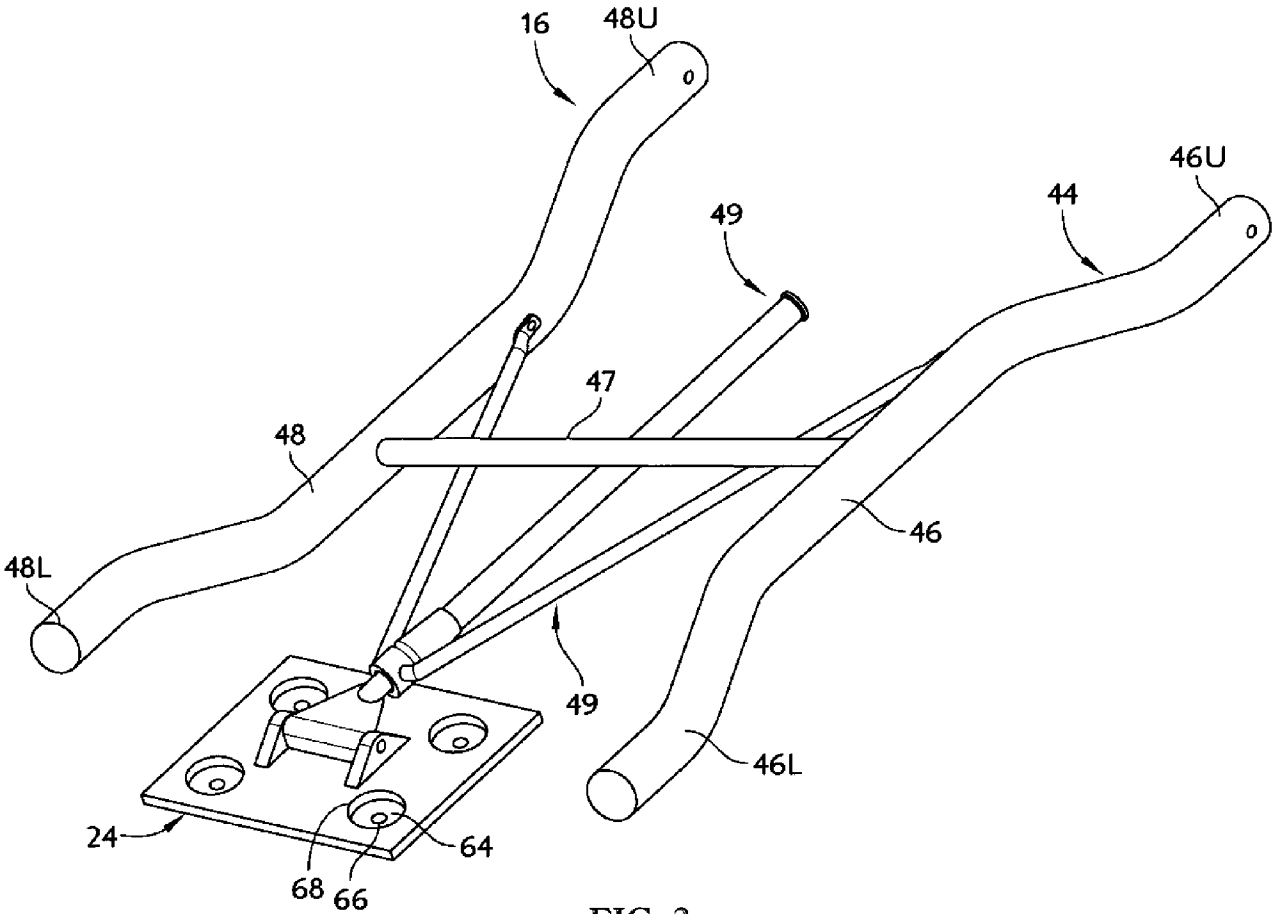
FIG. 2 is an enlarged perspective view of the first leg unit showing that the first leg unit includes an H-shaped tabletop support having spaced-apart first and second legs and a cross member interconnecting the first and second legs, a leg-unit anchor adapted to be coupled to the right-side portion of the table top as suggested in FIGS. 3-5, and a support-mover linkage coupled to the leg-unit anchor and to the first and second legs of the H-shaped tabletop support.

Each of first and second leg units 16, 18 includes an H-shaped table top support 44 having spaced-apart first and second legs 46, 48 and a cross member 47 interconnecting first and second legs 46, 48, a leg-unit anchor 24, and a support-mover linkage 49 coupled to leg-unit anchor 24 and to first and second legs 46, 48 as shown, for example, in FIGS. 1-3. As shown best in FIG. 1, first leg 46 includes an upper end 46U mounted for pivotable movement about a pivot axis 50 on a pivot pin 52 coupled to a companion corner bracket 54 included in table top 12 and coupled to bottom 36. Likewise, second leg 48 includes an upper end 48U mounted for pivotable movement about pivot axis 50 on a pivot pin 56 coupled to a companion corner bracket 58 included in table top 12 and coupled to bottom 36. Pivot pins 52, 56 support legs 46, 48 for pivotable movement about pivot axis 50 between a closed position shown in FIG. 1 and an opened position wherein lower end 46L of first leg 46 lies away from bottom 36 and lower end 48L of second leg 48 lies away from bottom 36 to engage a ground surface underlying table top 12 to hold table top 12 in an elevated position above the ground surface.

As suggested in FIGS. 1-3 and 5, leg-unit anchor 24 of first leg unit 16 is adapted to be coupled in a stationary position to right-side portion 26 of table top 12. Similarly, leg-anchor unit 24 of second leg unit 18 is adapted to be coupled in a stationary position to left-side portion 28 of table top 12.

As suggested in FIGS. 2 and 5, leg-unit anchor 24 includes a base plate 60, a catch 62 arranged to extend into cavity 22 and configured to include a bottom wall 64 formed to include a fastener-receiver aperture 66 and an annular (frustoconical) side wall 68 arranged to extend from base plate 60 to bottom wall 64. In an illustrative embodiment, four fastener-receiver apertures 66 are formed in leg-unit anchor 24 and are aligned with companion fastener-receiver apertures 39 formed in fastener mooring 38 when leg-unit anchor 24 is mated with table top 12 as suggested in FIGS. 1 and 3. When so mated, each bottom wall 64 of a catch 62 is arranged to lie in closely confronting relation to a companion top wall 38BT of a retainer 38B in cavity 22 formed in table top 12 as shown, for example, in FIG. 5.

As suggested in FIG. 5, in an illustrative embodiment, fastener 20 includes a bolt 70 including a head 72 and a neck 74 coupled to head 72 and a nut 76 arranged to mate with neck 74 of bolt 70. In an illustrative embodiment, when assembled, substantially all of bolt 70 and nut 76 lie in cavity 22 formed in table top 12 as shown in FIG. 4. Head 72 is trapped in an interior region 138B formed in retainer 38B and arranged to lie in a space bounded by top 30, side wall 38BS, and top wall 38BT. Neck 74 of bolt 70 is arranged to extend away from head 72 and through each of fastener-receiver apertures 39, 66 as suggested in FIG. 5. Nut 76 is mated to a free end (e.g., exposed portion) 78 of neck 74 to trap portions of bottom wall 64 of catch 62 of leg-unit anchor 24 and top wall 38BT of retainer 38B of fastener mooring 38 between head 72 and nut 76 as shown in FIG. 5. Nut 76 and retainer 62 cooperate to define a plate retainer coupled to bolt 70 to retain base plate 60 included in leg-unit anchor 24 in a stationary position on table top 12 as suggested in FIG. 5.

In illustrative embodiments, nut 76 is secured to exposed portion 78 of neck 74 of bolt 70 using any suitable connection means. In the illustrated embodiment, external threads in neck 74 mate with internal threads in nut 76. In other embodiments, adhesive, snap-fit, interference, or other suitable connection means could be used.

As suggested in FIG. 5, fastener 20 is located in cavity 22 formed in table top 12. Such a location minimizes any chance that clothing worn by a user of table 10 will snag on fastener 20.

Table 10 includes a table top 12 and a table top elevator 17 including a first leg unit 16 and a second leg unit 18 as suggested in FIGS. 1 and 3. Table 10 also includes several fasteners 20 configured to mount each of first and second leg units 16, 18 to table top 12 as suggested in FIGS. 3-5.

Table top 12 is configured to include a top surface 13 as suggested in FIGS. 3 and 5. Table top 12 is formed to include a cavity 22 having an opening in a bottom surface 14 provided on an underside 15 of table top 12 and arranged to lie in spaced-apart relation to top surface 13. In illustrative embodiments, a cavity 22 is provided for each fastener 20 used to mount each of first and second leg units 16, 18 to table top 12.

First leg unit 16 is arranged to lie under the underside 15 of table top 12 as suggested in FIG. 3. Table top elevator 17 further includes a fastener mooring 38 coupled to table top 12 as suggested in FIGS. 1, 3, and 5. In illustrative embodiments, one fastener mooring 38 is used to mount first leg unit 16 to table top 12 and another fastener mooring 38 is used to mount second leg unit 18 to table top 12.

Fastener mooring 38 includes a root plate 38A arranged to lie in a stationary position between top and bottom surfaces 13, 4 as suggested in FIGS. 3 and 5. Fastener mooring 38 also includes several retainers 38B wherein each retainer 38B is associated with one fastener 20 and coupled to root plate 38A and arranged to extend into a companion cavity 22.

First leg unit 16 includes a leg-anchor unit 24 arranged to confront one of the fastener moorings 38 and a table-leg system 44, 49 coupled to leg-anchor unit 24 as suggested in FIGS. 1 and 3 and configured to support table top 12 in an elevated position above an underlying surface. Leg-anchor unit 16 includes a base plate 60 located on bottom surface 14 of table top 12 and a catch 62 associated with each fastener and coupled to base plate 60 and arranged to extend into a companion cavity 22 as suggested in FIGS. 3 and 5.

Fastener includes a bolt 70 having a head 72 and a neck 74 as shown, for example, in FIGS. 4 and 5. Neck 74 is coupled to head 72 and arranged to locate head 72 between top surface 13 and neck 74. Neck 74 extends away from top surface 13 of table top 12 toward the opening formed in bottom surface 14 of table top 12 and through fastener-receiver apertures 39, 66 formed in each of retainer 38B included in fastener mooring 38 and catch 62 included in leg-anchor unit 16 to define an exposed portion 78 of neck 74 located in spaced-apart relation to head 70. Fastener 20 further includes a nut 76 secured to exposed portion 78 of neck 74 and located substantially in the companion cavity 22 to trap portions of retainer 38B and catch 62 between head 72 of bolt 70 and nut 76 to fix leg-anchor unit 24 of first leg unit 16 in a stationary position on underside 15 of table top 12.

Catch 62 includes a bottom wall 64 positioned to lie between nut 76 and fastener mooring 38 as shown in FIG. 5. Bottom wall 64 is formed to include a fastener-receiver aperture 66. Neck 74 includes a hidden portion 77 arranged to interconnect head 72 and exposed portion 78 and to extend through fastener-receiver aperture 66 of bottom wall 64 of catch 62 as suggested in FIG. 5.

Base plate 60 is arranged to lie in a first reference plane RP1 as suggested in FIG. 5. Bottom wall 64 of catch 62 is arranged to lie in a second reference plane RP2 that lies in substantially spaced-apart parallel relation to first reference plane RP1 as suggested in FIG. 5. Catch 62 further includes an annular side wall 68 arranged to interconnect an interior edge of base plate 60 and an exterior edge of bottom wall 64 and to surround nut 76 of fastener 20.

Retainer 38B of fastener mooring 38 includes a top wall 38BT positioned to lie between head 72 and bottom wall 64 of catch 62 as shown in FIG. 5. Hidden portion 77 of neck 74 is arranged to extend through a fastener-receiver aperture 39 formed in top wall 38BT. Nut 76 and fastener 20 cooperate to form means for clamping bottom and top walls 64, 38BT together in fixed relation to one another so that base plate 60 of leg-anchor unit 24 is held in a stationary position on table top 12 as suggested in FIGS. 1 and 5.

Root plate 38A of fastener mooring 38 is arranged to lie in a third reference plane RP3. Top wall 38BT of retainer 38B is arranged to lie in a fourth reference plane RP4 that lies in substantially spaced-apart parallel relation to third reference plane RP3. Retainer 38B further includes an annular side wall 38BS arranged to interconnect an interior edge of root plate 38A and an exterior edge of top wall 38BT and to surround head 72 of fastener 20.

Annular side wall 68 and bottom wall 64 of catch 62 cooperate to form a basin opening in a direction away from top surface 13 of table top 12. Nut 76 is sized to lie substantially wholly inside the basin. Exposed portion 78 of neck 74 is sized to lie substantially wholly inside the basin.

Retainer 38B of fastener mooring 38 includes a top wall 38BT positioned to lie between nut 76 and head 72 as shown in FIG. 5. Retainer 38B further includes a side wall 38BS arranged to interconnect root plate 38A and top wall 38BT and to lie between catch 62 and top surface 13 of table top 12. Side wall 38BS of retainer 38B is annular and arranged to surround head 72 of fastener 20. Side wall 38BS of retainer 38B is appended to an inner edge of root plate 38A and an outer edge of top wall 38BT. Top wall 38BT of retainer 38B is formed to include a fastener-receiver aperture 39. Neck 74 includes a hidden portion 77 arranged to interconnect head 72 and exposed portion 78 and to extend through fastener-receiver aperture 39 of top wall 38BT of retainer 38B.

Table top 12 further includes a support board 32 interposed between top and bottom surfaces 13, 14 as suggested in FIGS. 3 and 5. Root plate 38A of fastener mooring 38 is interposed between top surface 13 and support board 32 as suggested in FIGS. 3 and 5.

Support board 32 includes an annular interior surface arranged to face toward and surround retainer 38B of fastener mooring 38 and catch 62 of leg-anchor unit 24. Annular interior surface is arranged to surround exposed portion 78 of neck 74 and nut 76. Nut 76 is arranged to lie in an annular space provided between the annular interior surface of support board 32 and exposed portion 78 of neck 74.

The invention claimed is:

1. A table comprising a table top configured to include a top surface and formed to include a cavity having an opening in a bottom surface provided on an underside of the table top and arranged to lie in spaced-apart relation to the top surface, a table top elevator including a first leg unit arranged to lie under the underside of the table top and a fastener mooring coupled to the table top, the fastener mooring including a root plate arranged to lie in a stationary position between the top and bottom surfaces and a retainer coupled to the root plate and arranged to extend from the fastener mooring into the cavity, the first leg unit includes a leg-anchor unit and a table-leg system coupled to the leg-anchor unit and configured to support the table top in an elevated position above an underlying surface, the leg-anchor unit including a base plate located on the bottom surface of the table top and a catch coupled to the base plate and arranged to extend into the cavity, and a fastener including a bolt having a head and a neck coupled to the head and arranged to locate the head between the top surface and the neck and to extend away from the top surface of the table top toward the opening formed in the bottom surface of the table top and through fastener-receiver apertures formed in each of the retainer included in the fastener mooring and the catch included in the leg-anchor unit to define an exposed portion of the neck located in spaced-apart relation to the head, and wherein the fastener further includes a nut secured to the exposed portion of the neck and located substantially in the cavity to trap portions of the retainer and the catch between the head of the bolt and the nut to fix the leg-anchor unit of the first leg unit in a stationary position on the underside of the table top.

2. The table of claim 1, wherein the catch includes a bottom wall positioned to lie between the nut and the fastener mooring.

3. The table of claim 2, wherein the bottom wall is formed to include a fastener-receiver aperture and the neck includes a hidden portion arranged to interconnect the head and the exposed portion and to extend through the fastener-receiver aperture of the bottom wall of the catch.

4. The table of claim 3, wherein the base plate is arranged to lie in a first reference plane, the bottom wall of the catch is arranged to lie in a second reference plane that lies in substantially spaced-apart parallel relation to the first reference plane, and the catch further includes an annular side wall arranged to interconnect an interior edge of the base plate and an exterior edge of the bottom wall and to surround the nut of the fastener.

5. The table of claim 3, wherein the retainer of the fastener mooring includes a top wall positioned to lie between the head and the bottom wall of the catch and the hidden portion of the neck is arranged to extend through a fastener-receiver aperture formed in the top wall.

6. The table of claim 3, wherein the retainer of the fastener mooring includes a top wall positioned to lie between the head and the bottom wall of the catch and the nut and the fastener cooperate to form means for clamping the bottom and top walls together in fixed relation to one another so that the base plate of leg-anchor unit is held in a stationary position on the table top.

7. The table of claim 2, wherein the base plate is arranged to lie in a first reference plane, the bottom wall of the catch is arranged to lie in a second reference plane that lies in substantially spaced-apart parallel relation to the first reference plane, and the catch further includes an annular side wall arranged to interconnect an interior edge of the base plate and an exterior edge of the bottom wall and to surround the nut of the fastener.

8. The table of claim 7, wherein the annular side wall and the top wall cooperate to form a basin opening in a direction away from the top surface of the table top and the nut is sized to lie substantially wholly inside the basin.

9. The table of claim 7, wherein the annular side wall and the top wall cooperate to form a basin opening in a direction away from the top surface of the table top and the exposed portion of the neck is sized to lie substantially wholly inside the basin.

10. The table of claim 1, wherein the fastener mooring includes a top wall positioned to lie between the nut and the head.

11. The table of claim 10, wherein the retainer of the fastener mooring further includes a side wall arranged to interconnect the root plate and the top wall and to lie between the catch and the top surface of the table top.

12. The table of claim 11, wherein the side wall of the retainer is annular and arranged to surround the head of the fastener.

13. The table of claim 12, wherein the side wall of the retainer is appended to an inner edge of the root plate and an outer edge of the top wall.

14. The table of claim 10, wherein the top wall of the retainer is formed to include a fastener-receiver aperture and the neck includes a hidden portion arranged to interconnect the head and the exposed portion and to extend through the fastener-receiver aperture of the top wall of the retainer.

15. The table of claim 14, wherein the root plate is arranged to lie in a first reference plane, the top wall is arranged to lie in a second reference plane that lies in substantially spaced-apart relation to the first reference plane, and the retainer further includes an annular side wall arranged to interconnect an interior edge of the root plate and an exterior edge of the top wall and to surround the head of the fastener.

16. The table of claim 15, wherein the base plate is arranged to lie in a third reference plane, the bottom wall of the catch is arranged to lie in a fourth reference plane that lies in substantially spaced-apart parallel relation to the third reference plane, and the catch further includes an annular side wall arranged to interconnect an interior edge of the base plate and an exterior edge of the bottom wall and to surround the nut of the fastener.

17. The table of claim 1, wherein the table top further includes a support board interposed between the top and bottom surfaces and the root plate of the fastener mooring is interposed between the top surface and the support board.

18. The table of claim 17, wherein the support board includes an annular interior surface arranged to face toward and surround the retainer of the fastener mooring and the catch of the leg-anchor unit.

19. The table of claim 17, wherein the support board includes an annular interior surface arranged to face toward and surround the exposed portion of the neck and the nut and the nut is arranged to lie in an annular space provided between the annular interior surface of the support board and the exposed portion of the neck.

* * * * *